United States Patent [19]

Maeda

[11] 4,034,516

[45] July 12, 1977

[54] CENTRIFUGAL BLASTING APPARATUS

[76] Inventor: Riichi Maeda, 30-1, Kitakata 2 chome, Ichikawa, Chiba, Japan

[21] Appl. No.: 615,085

[22] Filed: Sept. 19, 1975

Related U.S. Application Data

[63] Continuation-in-part of Ser. No. 537,421, Dec. 30, 1974, Pat. No. 3,921,337.

[30] Foreign Application Priority Data

| | | |
|---|---|---|
| May 17, 1974 | Japan | 49-54455 |
| May 17, 1974 | Japan | 49-54456 |
| July 19, 1974 | Japan | 49-82284 |
| Mar. 11, 1975 | Japan | 50-28668 |
| May 17, 1974 | Japan | 49-54454 |

[51] Int. Cl.[2] ..... B24C 5/06

[52] U.S. Cl. ..... 51/432; 241/275

[58] Field of Search ..... 51/9 R, 9 M, 14, 15; 241/275

[56] References Cited

U.S. PATENT DOCUMENTS

| | | | |
|---|---|---|---|
| 2,205,414 | 6/1940 | Keefer | 51/9 R |
| 2,363,437 | 11/1944 | Peterson | 51/9 R |
| 3,694,963 | 10/1972 | Laliaert | 51/9 R |
| 3,785,105 | 1/1974 | Freeman | 51/9 R |
| 3,841,025 | 10/1974 | Maeda | 51/9 R |
| 3,921,337 | 11/1975 | Maeda | 51/9 R |

*Primary Examiner*—Gary L. Smith

[57] ABSTRACT

A centrifugal blasting apparatus including an improved blast wheel and an improved deflector. The blast wheel comprises a flat disk and a plurality of vanes attached to the disk and spaced equiangularly from each other. Each of the vanes is composed of a first face having a substantially right-angled triangle configuration and a second face of substantially triangular configuration. The second face extends from the hypotenuse of the first face farther off the axis of rotation of the blast wheel than the first face and slants laterally and backwards with respect to the direction of rotation of the blast wheel. The deflector has a feed slot extending through the peripheral wall thereof. The feed slot is substantially parallelogram shaped. Such a blasting apparatus can present a regular and widened blast pattern having a uniform distribution of abrasive particles, thereby giving a desirable even processing to the workpiece.

7 Claims, 16 Drawing Figures

CENTRIFUGAL BLASTING APPARATUS

This is a continuation-in-part of may co-pending application, Ser. No. 537,421, filed Dec. 30, 1974 now U.S. Pat. No. 3,921,337.

BACKGROUND OF THE INVENTION a. Field of the Invention

The present invention is concerned with a centrifugal blasting apparatus for blasting abrasive particles such as metallic shot against a workpiece to be cleaned or abraded. More particualrly, it relates to an improved centrifugal blasting apparatus including a rotatable blast wheel and a stationary deflector which are designed to produce a widened blast pattern having a uniform distribution of abrasive particles.

b. Description of the Prior Art

A conventional centrifugal blasting apparatus comprises, as shown in FIG. 9, a base frame 81, a casing 82 fixed to this base frame 81, a chute 83 for supplying abrasive particles, a cylindrical deflector or impeller case 84 attached to said chute 83, and a rotatable blast wheel 85 provided concentrically with said cylindrical deflector 84. The blast wheel 85 is rotated via a drive pulley 88 and a drive shaft 89 and includes a vane supporting disk 90 fixed to the shaft 89 and a plurality of vanes 91 which are substantially rectangular in shape. These vanes 91 are attached on one flat surface of the disk 90 radially thereof and spaced equiangularly from each other. In the central opening of the disk 90 is positioned an impeller 87 which is fixed to the shaft 89 and housed in the cylindrical deflector 84. A feed slot 92 which is either square or rectangular in configuration when viewed from directly thereabove is formed locally through the peripheral wall of the cylindrical deflector 84 so as to face the vane 91. Abrasive particles supplied via the chute 83 into the interior of the cylindrical deflector 84 are hurled by the impeller 87 through the feed slot 92 toward one surface of the respective vanes 91. The particles of abrasive are then propelled by the surfaces of the vanes 91 and blasted against the workpiece 86.

The direction of the blast stream produced by the conventional centrifugal blasting apparatus of the type described is virtually perpendicular to the axis of rotation of the blast wheel so that the blast pattern of abrasive particles cannot become much wider than the width $w$ of the vanes 91. Practically, the angle $\alpha$ of the blast pattern as shown in FIG. 10 is as small as 10°.

Because of this narrow blast pattern, the centrifugal blasting apparatus of the type descirbed tends to undesirably cause an uneven processing of workpieces. For example, when processing a workpiece having a channel section as shown in FIG. 11 while turning it about its center O on a turn table, the blasting apparatus can abrade the entire outer surfaces and the inner surface GH of the workpiece but cannot give a sufficient processing to the inner surfaces FG and HI. When a turning flat plate as shown in FIG. 12 is processed by the use of the above-mentioned conventional blasting apparatus, there also arises an uneven processing because the angle at which the abrasive particles impinge on the portions G and H closer to the center O is substantially different from the angle of impingement on portions F and I more distant from the center and the distances through which the particles travel before impinging the respective portions is different, and thus the processing forces differ.

To eliminate the aforesaid inconvenience, I, the inventor, have proposed, in Japanese Patent Application publication No. Sho 49-13675 published on Apr. 2, 1974, vanes of a blast wheel each comprising a central face of an isosceles triangular configuration and a pair of triangular sloping faces each extending from the isosceles edge of said central face laterally and backwards with respect to the direction of rotation of the blast wheel. The vane has the general configuration of an isosceles trapezoid when viewed from directly thereabove. By the use of the proposed blast wheel having the vanes constructed as above, the blast pattern has been spread in width, i.e. in the direction parallel to the axis of rotation of the blast wheel. However, it has been found that even the proposed blast wheel cannot avoid the uneven processing because of the fact that those abrasive particles thrown from the central portion of the vane have a noticeably different speed from those thrown from the lateral side portions of the vane. Moreover, due to the particular configuration as stated above, the vanes must be supported by a specially formed saucer-like disk. It will be appreciated that the production of such a saucer-like disk is more troublesome and requires more cost than the production of the flat disk used in said conventional centrifugal blasting apparatus.

Vanes of a blast wheel are sometimes thrown off the wheel when vanes are accidentally disengaged from the disk. In such a event, said conventional blasting apparatus has a tendency to throw the vanes toward a workpiece placed within the narrow stream of the abrasive particles because the direction of the flight of the vanes generally corresponds to that of the abrasive particles. As a result, workpieces are sometimes damaged by those vanes thrown by said conventional blasting apparatus. This presents a serious problem particularly in the case of processing of expensive workpieces such as parts for aircraft. In said proposed blasting apparatus, the vanes are not always thrown toward a workpiece, but there is no knowing in which direction the vanes will be thrown. Accordingly, there is still left the fear that the thrown vanes will damage a workpiece.

SUMMARY OF THE INVENTION

It is an object of the present invention to provide a centrifugal blasting apparatus including a blast wheel for widening the blast pattern of abrasive particles.

Another object of the present invention is to provide a centrifugal blasting apparatus including a blasting wheel of the type described which throws and spreads abrasive particles with a uniform distribution as well as imparts a substantially equal magnitude of velocity to the particles.

Still another object of the present invention is to provide a centrifugal blasting apparatus including a blast wheel of the type described which minimizes the amount of ineffective abrasive particles.

Still another object of the present invention is to provide a centrifugal blasting apparatus including a blast wheel of the type described which eliminates the fear that vanes accidentally detached from the disk will damage a workpiece.

Yet another object of the present invention is to provide a centrifugal blasting apparatus including a blast wheel of the type described the vanes of which do not require any specially formed disk but can be secured to a conventional flat disk.

A further object of the present invention is to provide a centrifugal blasting apparatus including a blast wheel of the type described the vanes of which are free from excessive wear. .

A still further object of the present invention is to provide a centrifugal blasting apparatus including a deflector which cooperates with the blast wheel of the type described to prevent local irregularity in the blast pattern.

A still further object of the present invention is to provide a centrifugal blasting apparatus which effectively reduces the length of time required for processing workpieces as compared with the prior art without causing any uneven processing.

A yet further object of the present invention is to provide a centrifugal blasting apparatus of the type described which can be made in a small size irrespective of its widened blast pattern.

According to the present invention, there is provided a centrifugal blasting apparatus including a chute, a stationary hollow cylindrical deflector connected at one open end thereof to said chute for receiving therewithin abrasive particles fed via said chute and provided with a feed slot extending through the peripheral wall thereof, a rotatable impeller positioned within said deflector with the axis of rotation thereof coinciding with the axis of the deflector for hurling the abrasive particles through said feed slot, a drive shaft carrying said impeller, and a rotatable blast wheel fixed to said drive shaft so as to be positioned concentrically with said deflector and rotated together with said impeller, said blast wheel comprising; a flat disk fixed to said drive shaft; and a plurality of vanes attached to the disk and spaced equiangularly from each other, said vanes each comprising a first face of a substantially right-angled triangular configuration and a second face of a substantially triangular configuration extending from the hypotenuse of said first face, at least a part of said second face slanting laterally and backwards with respect to the direction of rotation of said blast wheel, the distance from said disk to that apex of said second face which is opposite to the hypotenuse of said first face being greater than the length of the bottom edge of said first face which is positioned parallel with the axis of rotation of the blast wheel, the distance from said apex of said second face to said bottom edge of said first face being greater than the length of that edge of said first face perpendicular to the bottom edge, and said vanes being attached to said disk at said perpendicular edge of said first face in such a way that the bottom edge of said first face is parallel with the axis of rotation of said blast wheel and also that the top apex of said first face is positioned opposite to the axis of rotation with respect to the bottom edge of said first face.

According to the present invention, there is also provided a centifugal blasting apparatus including a feed slot which has a parallelogram shaped configuration.

The above and still further objects as well as advantages of the present invention will be more clearly understood from the following description when taken in conjunction with the accompanying drawings.

DETAILED DESCRIPTION OF THE PREFERRED EMBODIMENTS

Figure 1:
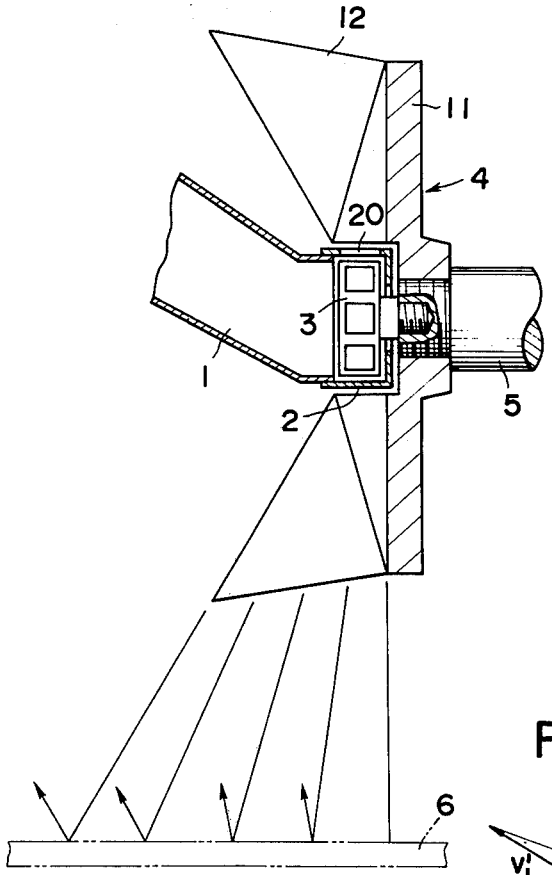
FIG. 1 is a sectional view diagrammatically showing an essential part of the centrifugal blasting apparatus according to the present invention.

FIG. 1 shows an essential part of a centrifugal blasting apparatus embodying the present invention. The centrifugal blasting apparatus comprises a chute 1 for supplying abrasive particles such as metallic shot for a cylindrical deflector or impeller case 2 attached thereto. The inlet of the chute 1 is connected to a supply of the abrasive particles (not shown) and the outlet thereof to one opening of the cylindrical deflector 2. An impeller 3 and a blast wheel 4 are mounted integrally and concentrically with each other on a drive shaft 5 so as to rotate together. The impeller 3 is housed in the cylindrical deflector 2. The drive shaft 5 for both the impeller 3 and the blast wheel 4 extends from the interior of the cylindrical deflector 2 through the other opening of the deflector and is connected to a power source (not shown). The deflector 2, the impeller 3, and the blast wheel 4 are arranged so that the central line of the cylinder of the deflector 2 coincides with the common axis of rotation of the impeller 3 and the blast wheel 4. In other words, these members are positioned with their circumferences concentrical.

The abrasive particles are fed from their supply into the deflector 2 via the chute 1. Then, the particles are hurled by the impeller 3 housed within the deflector 2 through a feed slot 20 formed in the circumferential wall of the deflector 2 to the blast wheel 4 and blasted thereby against the workpiece 6.

According to the present invention, the blast wheel 4 comprises a flat disk 11 and a plurality of vanes 12. The vanes are fixed to the disk 11 and equiangularly spaced from each other. The flat disk 11 is rigidly fixed to the drive shaft 5.

Figure 2:
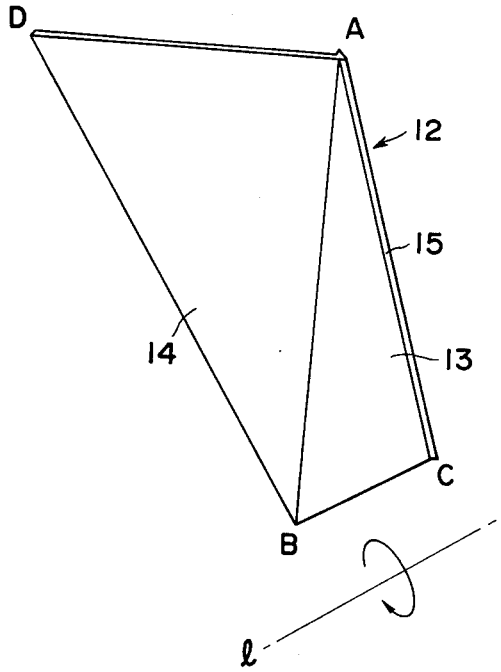
FIG. 2 is a perspective view showing a type of vane for a blast wheel of the centrifugal blasting apparatus of the present invention.

The respective vanes 12 have identical configurations, one of which is shown in FIG. 2 in a perspective view, respectively. The vane 12 is comprised of a first face 13 having a right-angled triangular configuration (ΔABC) and a second face 14 having a triangular configuration (ΔABD) connected with the first face 13 at the hypotenuse edge AB. These faces 13 and 14 have flat surfaces on which the abrasive particles are propelled. The first face 13 lies in a plane containing the axis of rotation of the blast wheel 4 and the second face 14 forms an angle with the central face 13 such that the second face 14 is slanting backwards with respect to the direction of rotation of the blast wheel. (In the following description, the term "backwards" will be used in terms of the direction of rotation of the blast wheel). The vane 12 is fixed to the disk 11 at the side edge AC perpendicular to the bottom edge BC. The bottom edge BC of the vane 12 is positioned parallel to the axis of rotation *l* of the wheel and the apex A is positioned at the opposite end of the side edge AC from the axis of rotation *l*.

As will be clear from FIGS. 1 and 2, the vane 12 is circumferentially wider in the axial direction than the length of bottom edge BC at the central, with respect to the blast wheel axis, end thereof. More specifically, the distance from the apex D of the slanting second face 14 to the disk 11 is greater than the length of the bottom edge BC parallel to the axis of shaft 5. The slanting second face 14 extends radially farther from the axis of rotation *l* of the blast wheel 12 than the first face 13 does so that the distance R between the axis of rotation *l* and the apex D is longer than the distance *r* between the axis *l* and the apex A (See FIG. 3).

Figure 3:
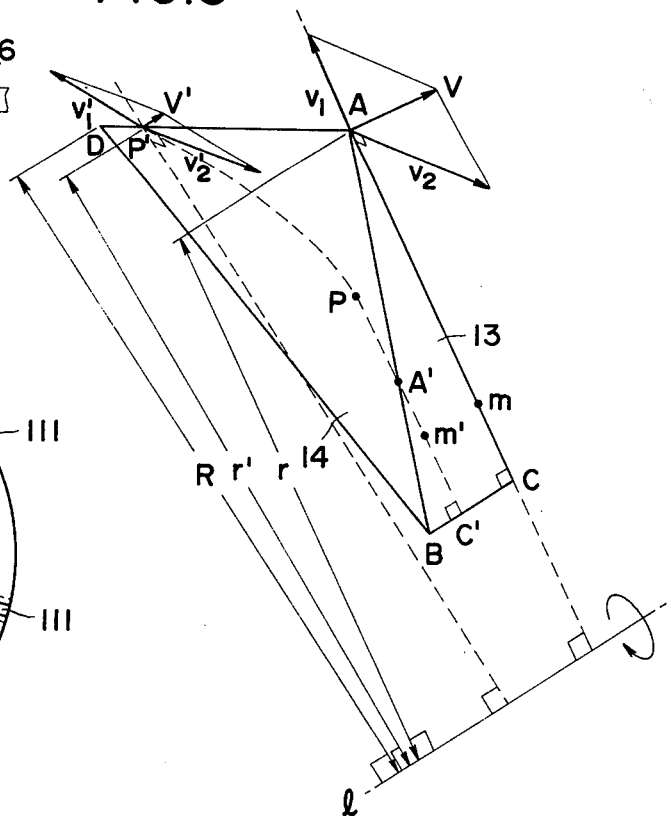
FIG. 3 is an explanatory diagram showing the movement of the abrasive particles on the vane of the blast wheel.

Referring particularly to FIG. 3, a description will hereinafter be given of the movement of abrasive particles on the vane 12 during the rotation of the wheel.

Through the feed slot 20 of the deflector 2, abrasive particles are fed uniformly to the vane 12 over the entire length of the bottom edge BC of the first face 13. Consideration is first directed to the case of an abrasive particle *m* supplied at the end C of the bottom edge BC. The particle *m* is accelerated on the first face 13 and it goes along the perpendicular edge AC. Then, the particle *m* leaves the central face 13 at the apex A and is blasted toward a workpiece at a resultant velocity V composed of a velocity component $v_1$ and another velocity component $v_2$. The velocity component $v_1$ lies in the plane containing the first face 13, i.e. in the direction coinciding with that of the perpendicular edge AC and said another velocity component $v_2$ is the velocity of rotation and is in the direction of a tangent to the circle of rotation of the blast wheel.

Next, consideration is directed to the case of an abrasive particle *m'* supplied at a point C' on the bottom edge BC spaced from the end C. The particle *m'* advances on the first face 13 along a line A'C' parallel with the perpendicular edge AC. Since the vane 12 is bent at the boundary line AB backwards with respect to the direction of rotation, the particle *m'* temporarily leaves the surface of the vane 12 at the point A' due to its inertia. However, the speed of rotation of the vane 12 becomes greater as it goes radially outwardly so that the particle *m'* lands on the slanting second face 14 at a point P which lies on the extension of the line A'C'. Not only a centrifugal force in the radial direction but also a force oriented laterally and backwards with respect to the direction of rotation acts on the particle *m'* because the second face 14 is slanting backwards with respect to the direction of rotation of the blast wheel. As a result, while the particle *m'* moves forward in the radial direction, it goes farther away from the perpendicular edge AC of the vane 12, thus following a curving locus on the slanting second face 14.

When the particle *m'* reaches a point P' located on the outermost free edge AD of the slanting second face 14, it is thrown at a resultant velocity V' composed of a velocity component $v_1'$ lying in the plane containing the slanting second face 14 and a velocity component $v_2'$ which is the velocity of rotation in the direction of a tangent to the circle of rotation of the blast wheel.

Similarly, those abrasive particles supplied uniformly over the entire length of the bottom edge BC of the vane 12 are, except for that particle supplied at the end C, oriented on the slanting second face 14 in directions deviated from the directions imparted originally to the particles and they are distributed uniformly over the length of the outermost free edge AD of the slanting second face 14 and then thrown therefrom.

As will be understood from FIG. 3, those abrasive particles about to be blasted from the points on the free edge AD have velocity components in such directions so as go farther away from the perpendicular edge AC of the first face 13, so that those particles are radiated from the outer free edge AD.

For an even and effective processing, it is desired that the speeds V and V' at which the particle *m* and *m'* are thrown toward the workpiece be equal to each other. The present invention achieves this for the following reasons. That is to say, in the above-mentioned vane, the directions of the velocity components $v_1'$ and $v_2'$ are at an obtuse angle while the directions of the velocity components $v_1$ and $v_2$ are at a right angle. On the other hand in practice, the magnitude of the velocity component $v_1$ and that of the velocity component $v_1'$ are equal with each other due to various factors such as the friction between the particles and the surface of the vane, the length along which the particles pass on the vane, and the wind velocity on the vane. In addition, the magnitude of the velocity component $v_2'$ is greater than that of the velocity $v_2$ due to the fact that the distance *r'* between any point located on the outermost free edge AD of the slanting second face 14 and the axis of rotation *l* is greater than the distance *r* between the apex A and the axis *l*. Therefore, according to the present invention, the magnitude of the velocity V and that of the velocity V' can be made substantially equal to each other.

As has been explained, in the blast wheel according to the present invention, those abrasive particles thrown from the slanting second face of the respective vanes are given a velocity component having a direction oblique to the axis of rotation *l* of the wheel. As a result, the area covered by the blasted particles is substantially greater in breadth than the blast wheel. At the same time, since the radius of the extremity of the slanting second face is greater than that of the radially outermost apex of the first face, the magnitude of the velocity at which the particles are blasted can be made substantially equal at any point of the free edge line of the vane. In addition, the abrasive particles fed uniformly over the entire length of the bottom edge of the vane are presented uniformly over the free edge of the slanting second face and thrown therefrom. As a result, there is obtained a blast pattern having a uniform distribution of abrasive particles. Therefore, an uneven processing of a workpiece is effectively prevented.

Figure 4:
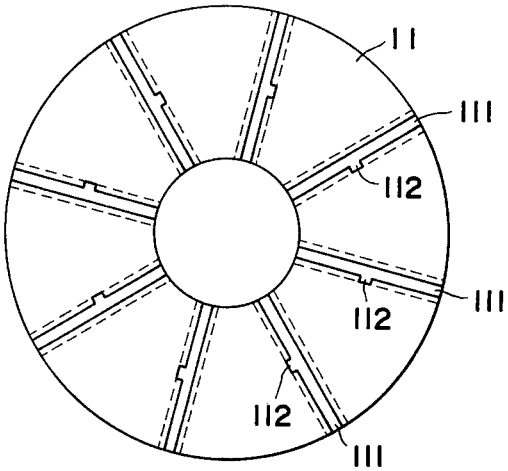
FIG. 4 is a side view of a conventional flat disk used for supporting the vanes according to the present invention.

Referring now to FIG. 4, a description will be given of the fixing of the vanes to the disk. The disk 11 is a conventional one and has a boss on its outer surface. The boss is provided with a threaded bore for receiving the drive shaft 5 therewithin to fix the disk 11 to the shaft 5. The disk 11 has a plurality of dovetail grooves 111 extending radially on its flat inner surface and spaced equiangularly from each other. Each vane 12 has a dovetail projection 15 along the perpendicular edge AC of the first face 13, as shown in FIG. 2. By inserting the dovetail projection 15 of the vane 12 into one of the dovetail grooves 111 of the disk 11, the vane 12 is attached to the disk 11. The vane is further rigidly fixed to the disk 11 by placing a key at 112 of the disk 11.

As stated above, the vane 12 which can produce a widened blast pattern does not require any specially formed disk but can be attached to a conventional flat disk.

In the event that the vane 12 is accidentally detached from the disk 11 during its rotation, the vane 12 will be thrown radially of the disk 11 and parallel with the flat inner surface of the disk 11. Since the abrasive particles are radiated from the outermost free edge of the vane as shown in FIG. 1, a workpiece can be placed within the stream of blasted abrasives at a position laterally spaced from the disk by a distance greater than the dimension of the radially outermost edge of the vane parallel to the axis of rotation. By placing expensive workpieces at such a position, they are prevented from being damaged even in the event of the detachment of the vane 12 from the disk 11.

In addition, the vane 12 has a slightly larger size than a conventional one and it can can produce a much wider blast pattern than a conventional one can. As a result, according to the present invention, a centrifugal blasting apparatus can be made in a relatively small size yet still have a wide blast pattern.

Modified vanes for the blast wheel will now be explained by referring to FIGS. 5 to 8.

Figure 5:
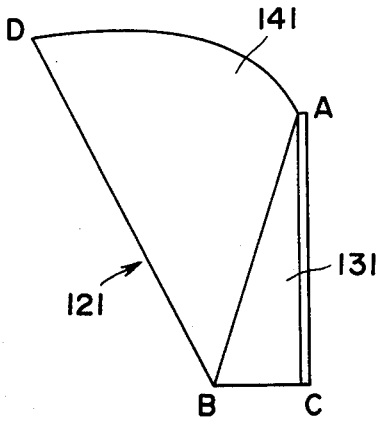
FIGS. 5 to 7 each show a plan view of a modified vane.

FIG. 5 shows a modification of the vane. A vane 121 as shown in this figure is similar in configuration to the vane 12 as shown in FIGS. 2 and 3, with the exception that the outermost free edge AD of the slanting second face 141 projects arcuately outwardly.

The slanting second face 141 thus formed presents landing areas for those abrasive particles which have been supplied at points slightly spaced from the apex C, advanced on the first face 131 and then left this face. In other words, those particles supplied near the apex C are prevented from being thrown directly from the first face 121 without being controlled by the slanting second face 141. Therefore, the slanting second face 141 having the arcuately projecting edge portion exerts control over almost all of the abrasive particles supplied and thrown them against the workpiece so that the amount of ineffective particles is minimized. In addition, the advantages described in connection with the vanes 12 are true of these vanes 121 having the slanting second face 141 provided with the arcuately radially outwardly projecting edge portions.

Figure 6:
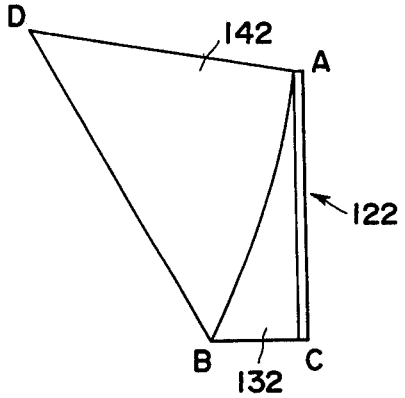

FIG. 6 shows a further modification of the vane. A vane 122 as shown in this figure is substantially same as the vane 12 shown in FIGS. 2 and 3 with the exception that the boundary line AB between the first face 132 and the slanting second face 142 is projects curvilinearly inwardly of the first face 132. More specifically, the boundary line is so curved as to substantially reduce the breadth of the first face 132 in the vicinity of the apex A.

Owing to the construction as described above, the distance between that part of the boundary line AB near the apex A and the outermost free edge AD is increased. As a result, when those abrasive particles fed at points slightly spaced from the apex C reach the boundary line AB, there is left a considerable length of second face 142 before they reach the free edge AD. Accordingly, they are not thrown off the vane 122 directly from the first face 132 but land on the slanting second face 142. Thus, the slanting second face 142 can control almost all of the abrasive particles and throw them against the workpiece without throwing any useless particles. In addition, the advantages of the vanes 12 as shown in FIGS. 2 and 3 are true of these vanes 122.

Figure 7:
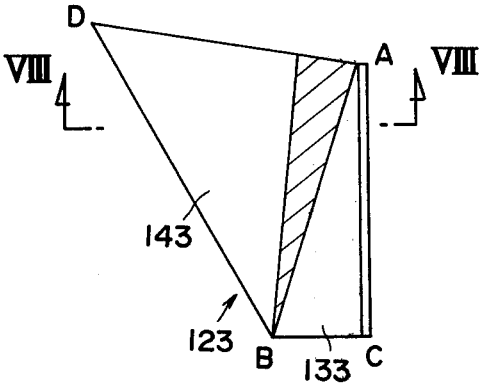
Figure 8:
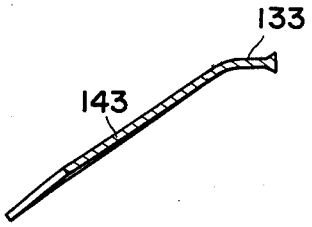
FIG. 8 is a sectional view taken along the line VIII—VIII in FIG. 7.
Figure 9:
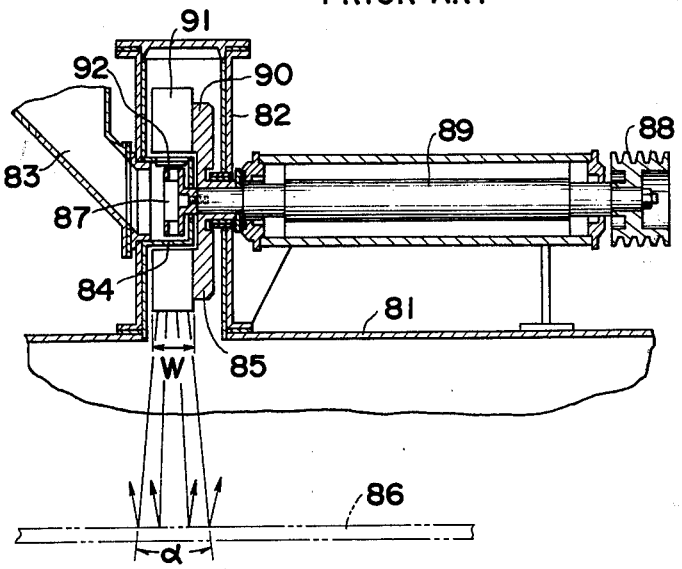
FIG.9 PRIOR ART
FIG. 9 is a vertical sectional view of a known centrifugal blasting apparatus.
Figure 10:
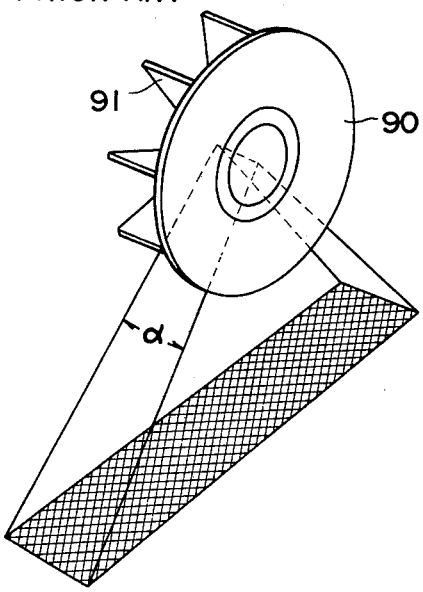
FIG. 10 PRIOR ART
FIG. 10 is an explanatory view diagrammatically showing a conventional blast wheel used in the known centrifugal blasting apparatus as shown in FIG. 9 and the blast pattern produced thereby.
Figure 11:
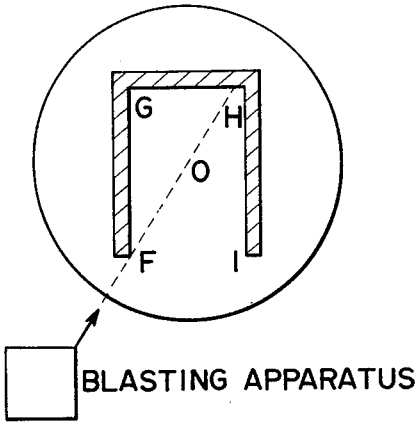
FIG. 11 PRIOR ART
FIGS. 11 and 12 show the function of the known blasting apparatus as shown in FIG. 9.
Figure 12:
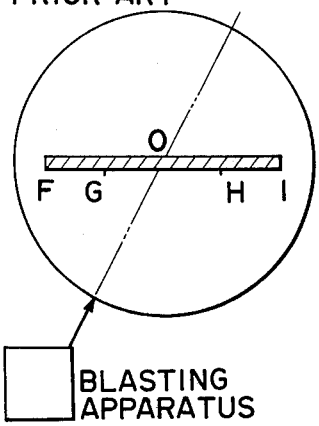
FIG. 12 PRIOR ART

FIGS. 7 and 8 show a still further modification of the vane. A vane 123 as shown in these figures is almost identical in configuration with the vane 12 shown in FIGS. 2 and 3. with the exception that the slanting second face 143 is convexly curved in the vicinity of the connection with the first face 133. More specifically, the slanting second face 143 has a convexly round surface extending along its connection with the first face 133. The convexly curved surface has a substantially triangular configuration when viewed from directly thereabove, the surface being shadowed in FIG. 7. The breadth of the convex surface becomes gradually greater as it goes from the apex B of the slanting second face 143 to the outermost free edge AD along the boundary line AB between the faces 133 and 143.

Due to the presence of the convex surface in the vicinity of the boundary line between the first face 133 and the slanting second face 143, the abrasive particles do not leave the surface of the vane 123 even when they pass from the first face 133 to the slanting second face 143, but they are constantly controlled by the surface of the vane 123 until they reach the outermost free edge AD. Accordingly, those particles supplied at points slightly spaced from the apex C do not leave the first face 133 directly outwardly off the vane and thus it can be safely said that all of the particles supplied are thrown from the free edge of the slanting second face 143. As a result, the blasting by the use of the vanes 123 is free from any loss of the particles and an abnormal wear of the surface of the vanes which might be caused, but for the convex portion, by the landing of the particles on the slanting second face. In addition, the advantages described in connection with the blast wheel having the vanes 12 are true of the blast wheel provided with these vanes 123.

It should be understood that the above-described modified vanes 121, 122 and 123 are provided in the blast wheel in the same way as the vanes 12.

It should be understood also that the first face of the vane may lie in a plane which does not contain the axis of rotation of the blast wheel.

Referring to FIGS. 13 to 16, a deflector cooperating with the blast wheel described above will hereinafter be explained.

Figure 15:
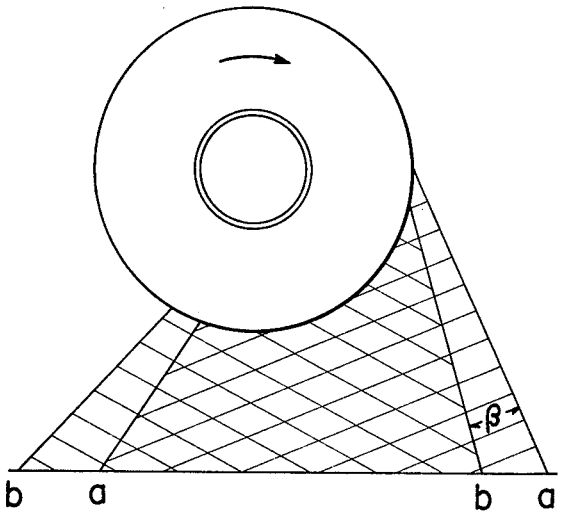
FIGS. 15 and 16 are explanatory illustrations diagrammatically showing the blast pattern of abrasive particles.
Figure 16:
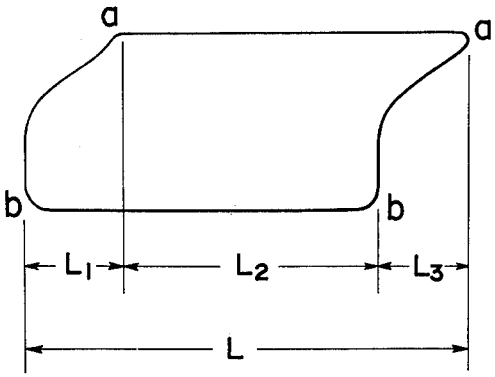

By the use of the vanes as shown in FIGS. 2 to 8, there is obtained the advantage that the width of the blast pattern becomes greater as compared with the prior art. However, if these vanes are used with the known deflector having a feed slot which is either square or rectangular in configuration when viewed directly from thereabove, the area covered by the thrown abrasive particles presents a pattern like a parallelogram, as shown in FIG. 16. The reason therefor is that those particles thrown from the vane portions laterally remote from the disk have travelled through a longer distance as compared with those thrown from the vane portions near the disk and that therefore the former are thrown later than the latter. More specifically, those particles thrown from the portions near the disk are presented in the *a—a* section of the blast pattern as shown in FIGS. 15 and 16 and those particles thrown from the laterally remote portions from the disk are in the *b—b* section. In other words, the throwing of the particles from the laterally remote portions of the vane is effected at the time the blast wheel further rotates after the throwing from the portions near the disk.

The above-described blast pattern is not desirable because sometimes it may cause uneven processing. For example, let us assume that a workpiece having a width corresponding to the length L of the blast pattern shown in FIG. 16 is to be processed while displacing it in the direction perpendicular to the length of the blast pattern, i.e. in the direction of the arrow Y. Then, the region of the workpiece covered with the area $L_3$ receives the smallest amount of abrasive particles and the region covered with the area $L_2$ receives the largest amount of particles. This results difference in processing of the regions covered with the areas $L_1$, $L_2$ and $L_3$.

Figure 13:
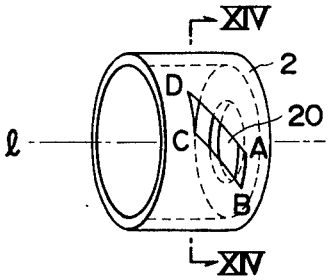
FIG. 13 is a perspective view of a deflector in the centrifugal blasting apparatus according to the present invention.
Figure 14:
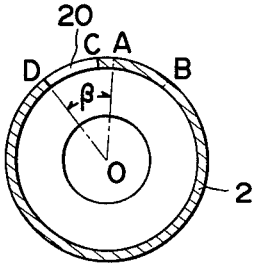
FIG. 14 is a sectional view taken along the line XIV—XIV in FIG. 13.

FIGS. 13 and 14 show a deflector according to the present invention which produces a regular blast pattern when used with the vanes as shown in FIGS. 2 to 8.

The deflector 2 has a hollow cylindrical body and a feed slot 20 formed in the peripheral wall of the body. The feed slot 20 has a parallelogram shaped configuration when viewed from directly thereabove. More specifically, the edge AB of the feed slot 20 positioned near the disk is constituted by a part of a line formed by the intersection of a plane perpendicular to the axis *l* of the deflector 2 and the cylindrical body of the deflector. Another edge BC of the feed slot 20 is constituted by a part of a line formed by the intersection of the cylindrical body of the deflector 2 and a plane crossing at an angle both the axis *l* of the deflector and the direction of rotation of the impeller and blast wheel. The other edges DC and AD are identical to and parallel with the edges AB and BC and in spaced relation thereto, respectively. The parallel edges AB and DC extend in a direction coinciding with the direction of rotation of the impeller and blast wheel. The edge AB is positioned closer to the disk than the edge DC and more forward with respect to the direction of rotation of the impeller and blast wheel than the edge DC.

Let us assume that the *a—a* section and the *b—b* section in FIG. 15 form an angle $\beta$ when the blast wheel having the vanes according to the present invention is used with the known deflector provided with the feed slot in the shape of either a square or a rectangle. Then, the feed slot 20 according to the present invention should be so constructed that the point D and the point A form a central angle corresponding to the angle $\beta$ about the axis *l* of the deflector 2, as shown in FIG. 14. By doing so, an amount of abrasive particles can be supplied for the vane portions near the disk at the time the impeller integral with the blast wheel has been rotated through the angle $\beta$ after the supplying of an amount of particles for the portions of the vane laterally spaced from the disk. As a result, a regular blast pattern is obtained by the use of the deflector according to the present invention even when the blast wheel for presenting a widened blast pattern is employed. Accordingly, the aforesaid uneven result of processing caused by the irregularity in the blast pattern is eliminated.

As many apparently widely different embodiments of the present invention may be made without departing from the spirit and scope thereof, it is to be understood that the invention is not limited to the specific embodiments thereof except as defined in the appended claims.

What is claimed is:

1. A centrifugal blasting apparatus including a chute, a stationary hollow cylindrical deflector connected at one open end thereof to said chute for receiving therewithin abrasive particles fed via said chute and having a feed slot extending through the peripheral wall thereof, a rotatable impeller positioned within said deflector with the axis of rotation thereof coinciding with the axis of the deflector for hurling the abrasive particles through said feed slot, a drive shaft carrying said impeller, and a rotatable blast wheel fixed to said drive shaft so as to be positioned concentrically with said deflector and rotated together with said impeller, said blast wheel comprising:

a. a disk fixed to said drive shaft; and b. a plurality of vanes, attached to said disk and spaced equiangularly from each other, said vanes each comprising a first face having a substantially right-angled triangular configuration with a radially extending side edge and a radially inner, with respect to said drive shaft, edge and a second face having a substantially triangular configuration extending from the hypotenuse edge of said first face, at least a part of said second face slanting laterally and backwards with respect to the direction of rotation of said blast wheel, the distance from said disk to that apex of said second face which is opposite to the hypotenuse of said first face being greater than the length of the radially inner edge of said first face, the radial distance from said apex of said second face to the radially inner edge of said first face being greater than the radial length of said radially extending side edge of said first face, and said vanes being attached to said disk at said radially extending side edge of said first face in such a way that the radially inner edge of said first face toward the axis of rotation of said blast wheel and the apex of said first face remote from the axis of rotation with respect to the radially inner edge of said first face.

2. A centrifugal blasting apparatus according to claim 1 in which said disk has a flat surface with a plurality of dovetail grooves radially extending therein and in which said vanes each has a dovetail projection extending along said radially extending edge of said first face.

3. A centrifugal blasting apparatus according to claim 2 in which said feed slot has a parallelogram-shaped configuration.

4. A centrifugal blasting apparatus according to claim 3 in which said first face and said second face are an obtuse angle at the boundary line thereof.

5. A centrifugal blasting apparatus according to claim 3 in which said second face has a convexly curved surface along the boundary line between said first and second faces, the breadth of the convexly curved surface becoming gradually greater as extends farther from the axis of rotation of said blast wheel.

6. A centrifugal blasting apparatus according to claim 3 in which the free edge of said second face projects arcuately outwardly of said blast wheel.

7. A centrifugal blasting apparatus according to claim 3 in which the boundary line between said first and second faces extends curvilinearly inwardly of said first face, thereby substantially reducing the breadth of said first face in the vicinity of the top apex thereof.

* * * * *